United States Patent [19]

Daniels et al.

[11] 4,438,169

[45] Mar. 20, 1984

[54] COLORED OPAQUE PRINTING OF TEXTILE FABRICS USING DYESTUFFS

[75] Inventors: John Y. Daniels, Pineville, N.C.; James C. Stevenson, Rock Hill, S.C.

[73] Assignee: Springs Industries, Inc., Fort Mill, S.C.

[21] Appl. No.: 435,949

[22] Filed: Oct. 22, 1982

Related U.S. Application Data

[63] Continuation-in-part of Ser. No. 429,794, Sep. 30, 1982, which is a continuation-in-part of Ser. No. 294,782, Aug. 20, 1981, abandoned.

[51] Int. Cl.[3] ..... B32B 3/00

[52] U.S. Cl. ..... 428/196; 8/495; 427/282; 427/288; 427/389.9; 428/206; 428/207; 428/240; 428/244; 428/324; 428/325; 428/329; 428/331; 523/222

[58] Field of Search ..... 8/495; 428/196, 206, 428/207, 240, 244, 324, 325, 329, 331; 427/282, 288, 389.9; 523/222

[56] References Cited

U.S. PATENT DOCUMENTS

| | | | |
|---|---|---|---|
| 2,310,436 | 2/1943 | Johnson . | |
| 3,441,427 | 4/1969 | Skofronick | 427/288 |
| 3,443,979 | 5/1969 | Skofronick | 427/288 |
| 3,948,597 | 4/1976 | Sakaoka . | |
| 4,280,888 | 7/1981 | Buch et al. | 428/207 |
| 4,283,452 | 8/1981 | Marco | 428/253 |
| 4,315,790 | 2/1982 | Rattie et al. | 428/207 |
| 4,351,871 | 9/1982 | Lewis et al. | 428/196 |

FOREIGN PATENT DOCUMENTS

| | | |
|---|---|---|
| 1104927 | 4/1961 | Fed. Rep. of Germany . |
| 1107636 | 5/1961 | Fed. Rep. of Germany . |
| 1444060 | 12/1968 | Fed. Rep. of Germany . |
| 1296602 | 6/1969 | Fed. Rep. of Germany . |
| 1120896 | 7/1956 | France . |
| 1593299 | 7/1970 | France . |
| 2402733 | 4/1979 | France . |
| 7312428 | 4/1974 | Netherlands . |
| 589782 | 6/1947 | United Kingdom . |

*Primary Examiner*—James J. Bell

*Attorney, Agent, or Firm*—Bell, Seltzer, Park & Gibson

[57] ABSTRACT

Highly opaque printed areas are produced on uncolored or precolored fabrics with the use of an aqueous opaque printing paste comprising a dispersion of an opacifying pigment, an aqueous curable polymer binder, and a dye for coloring the polymer binder and thereby imparting a predetermined desired color to the printed area. In accordance with the invention multicolor prints with a variety of unique and visually appealing shade possibilities and color effects not heretofore possible are achieved.

12 Claims, 3 Drawing Figures

COLORED OPAQUE PRINTING OF TEXTILE FABRICS USING DYESTUFFS

CROSS-REFERENCE TO RELATED APPLICATIONS

This application is a continuation-in-part of commonly owned copending U.S. Pat. application Ser. No. 429,794 filed Sept. 30, 1982, entitled "Textile Fabrics With Opaque Pigment Printing and Method of Producing Same," which in turn, is a continuation-in-part of U.S. Pat. application Ser. No. 294,782, filed Aug. 20, 1981, now abandoned.

FIELD AND BACKGROUND OF THE INVENTION

The present invention relates to textile pigment printing, and in particular to the production of a printed textile fabric wherein the printed areas are of a predetermined desired color and are characterized by being substantially opaque and thus unaffected by the color of the underlying yarns. This invention is related to and is an improvement over the invention described in the above-referenced commonly owned earlier applications.

These earlier applications disclose a unique new type of textile printing process and product in which the printed areas on the textile fabric are substantially opaque and are thus unaffected by the color of the underlying yarns. The aqueous opaque printing process and product of these earlier applications overcomes a number of significant limitations and disadvantages of conventional pigment printing techniques and enables the production of a wide variety of patterns and colors not obtainable by the pigment printing techniques heretofore known. The printing paste which is used in the opaque printing process, unlike the aqueous printing pastes used in conventional screen printing operations, has opacity and can be applied over either dark or light background fabrics without being affected by the color of the underlying yarns. The resulting printed pattern areas on the fabric comprise an opaque coating which covers the exposed surfaces of the yarns which form the fabric. This coating comprises an opacifying pigment providing opacity in the coating and a cured water insoluble polymer binder which is affixed to the yarns and bonds the opacifying pigment to the yarns. The opaque coating which forms the printed pattern areas is characterized by individually coating each of the yarns in the printed area such that the interengaged yarn structure of the fabric is not obliterated, but remains visible. More specifically, the opaque coating is further characterized by individually encapsulating and coating the exposed fibers at the surface of the yarn such that the individual surface fibers of the yarn also are not obliterated and remain visible.

The opaque coating which forms the printed pattern areas may be of any desired color. For relatively light colors, such as white, the opacifying pigment itself may be utilized for providing the desired colors. The above-referenced earlier applications further disclose that other colors may be produced by including colored pigments in the printing paste in addition to the opacifying pigment.

SUMMARY OF THE INVENTION

The present invention is based upon the use of dyes, either alone or in combination with colored pigments, for coloring an aqueous opaque printing paste of the type described in the above-referenced applications. The use of dyes, by themselves or with colored pigments, broaden the possible range of shades which can be obtained and provide a means of achieving brighter shades and deeper depths. The use of water soluble dyes will also provide better printability by lowering the tendency of screen clogging. The dyes are selected for their compatibility with the polymeric materials used in the binder system, and actually serve to color the polymeric binder.

Thus, the present invention is directed broadly to a printed textile fabric formed of interengaged yarns of a predetermined color, with selected areas of the fabric having printed pattern areas of predetermined color contrasting with the color of the yarns, the printed pattern areas being substantially opaque and thus unaffected by the color of the yarns. The printed pattern areas comprise an opaque coating covering the exposed surfaces of the interengaged yarns and hiding the underlying color of the yarns. The coating comprises an opacifying pigment providing opacity in the coating, a cured water insoluble binder affixed to the yarns and bonding the opacifying pigment to the yarns, and a dye coloring the polymer binder and thereby imparting said predetermined color to the printed area. The opaque coating may optionally additionally include colored pigments in addition to the dyes for assisting the dyes in providing the predetermined color to the printed pattern areas.

The polymer binder may contain reactive dye sites available for bonding with the dye, and with the dye being chemically reacted with said dye sites. Dyes which may be suitably employed in the present invention may comprise any of the dyes conventionally used in the dyeing of textile fabrics. Examples of a preferred class of dyes for use in the present invention comprise at least one member selected from the group consisting of acid dyes, cationic dyes, direct dyes, disperse dyes, fiber reactive dyes, mordant dyes, and solvent dyes.

The opaque coating which forms the printed pattern areas is characterized by individually coating each of the yarns in the printed area such that the interengaged yarn structure of the fabric is not obliterated, but remains visible. More specifically, the opaque coating is further characterized by individually encapsulating and coating the exposed fibers at the surface of the yarn such that the individual surface fibers of the yarn also are not obliterated and remain visible.

In one aspect of the invention, through the use of a rotary screen printing range or other suitable apparatus for applying a plurality of opaque printing paste colors or shades, a novel class of visually appealing fabrics is produced in which the printed pattern areas are formed of a plurality of colors contrasting with one another and with the predetermined color of the yarns, at least one of the colors being lighter than the color of the yarns. Various other unique patterns and effects can be produced, as will become apparent from the detailed description and examples which follow.

The aqueous opaque colored printing paste of this invention is comprised of a stable aqueous dispersion of an opacifying pigment, a polymer binder which is capable of being cured to a water insoluble state in which it is affixed to the yarns and serves to bond the opacifying pigment to the yarns, and a dye which is compatible with the polymer binder and which serves to impart a predetermined desired color to the binder. The printing paste may also optionally include relatively smaller amounts of other materials, such as crosslinking agents, thickeners, emulsifiers, pH control agents, and the like. The opacifying pigment and the curable polymer binder are the major constituents, however, and are present in concentrations such as to provide a printing paste with a very high solids content, e.g. preferably greater than about 25 percent total solids, which is considerably higher than conventional aqueous printing pastes. The printing paste desirably comprises at least about 20 percent by weight opacifying pigment (solids basis) and at least about 5 percent by weight polymer binder (solids basis). This combination of pigment and polymer binder is applied to the fabric in an amount sufficient to form in the dried and cured fabric a highly opaque coating which covers the exposed surface of the yarns of the fabric, thereby completely hiding the underlying color of the yarns. The aqueous printing paste formulation of the invention, by individually coating each yarn, penetrates into the fabric and is generally visible on both the front and reverse sides thereof. This penetration into the fabric and the individual coating or encapsulation of the yarns provides excellent durability and washfastness properties in the printed fabrics. The porosity, flexibility and tactile properties of the fabric are not adversely affected, and indeed, are considerably better than in the printed areas obtained by conventional pigment printing and solvent-based lacquer printing techniques of the prior art. Printed areas produced by these techniques, in contrast to the printed areas produced pursuant to the invention, are characterized by forming a skin or coating which tends to remain on the surface of the fabric and is thus subject to abrasion and wear.

BRIEF DESCRIPTION OF THE DRAWINGS

Some of the features and advantages of the invention having been stated, others will become apparent from the detailed description and examples which follow, and from the accompanying drawings, in which.

DETAILED DESCRIPTION

Figure 1:
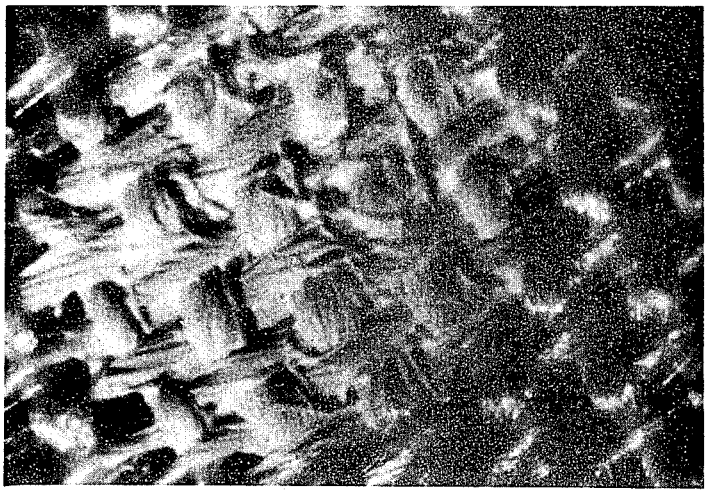
FIG. 1 is a photomicrograph illustrating a woven fabric with an opaque colored printed area thereon.

The aqueous opaque colored printing paste of the present invention has a relatively high solids content, e.g. preferably at least 25 percent total solids, and consists mainly of an opacifying pigment and a curable polymer binder mixed therewith to form a stable aqueous dispersion.

To serve as an opacifying pigment for purposes of this invention, the material must be highly opaque, have color properties which permit it to be used alone or mixed with other colorants, such as dyes and colored pigments, and it must be readily dispersable at relatively high concentrations in the aqueous binder system. There are many commercially available materials having these characteristics. Where it is desired to provide a relatively light colored printed area, particularly against a relatively darker background color, the preferred opacifying pigment for use in the printing paste formulation of this invention is a white pigment. One particular white pigment which has been found to be especially suitable because of its bright white appearance, cost and availability is titanium dioxide. Other suitable white pigments include silicates, aluminum compounds, calcium carbonate, and the like. In order to achieve high chroma (color saturation) with certain hues, one or more opacifying pigments of lesser whiteness or of intermediate shades may be employed, either alone or in combination with white pigments.

In addition to the white opacifying pigments noted above, examples of other compounds suitable for use as opacifying pigments in the present invention include the following: zinc oxide, zinc sulfide, lithopone ($ZnS/BaSO_4$), basic carbonate white lead, basic sulfate white lead, lead oxide (lead dioxide), calcium sulfate, barium sulfate, silica, clay ($Al_2O_3 \cdot 2SiO_2 \cdot 2H_2O$), lead sulfate, magnesium silicate, mica, wollastonite ($CaSiO_3$), aluminum hydrate, magnesium oxide, magnesium carbonate, aluminum oxide, ferric oxide, sodium carbonate, strontium sulfide, calcium sulfide, barium carbonate, antimonius oxide, zirconium white, barium tungstate, bismuth oxychloride, tin white, lead silicate, chalk, bentonite, barium sulfate, gloss white, gypsum, zinc phosphate, lead phosphate, and calcium silicate. For the printing of relatively dark colors, carbon black may be used as an opacifying pigment instead of a lighter colored pigment.

The use of an opacifying pigment, particularly a white opacifying pigment, and the printing thereof against a darker background color, are features which clearly distinguish the opaque pigment printing of this invention over conventional non-opaque pigment printing techniques. In conventional pigment printing, white pigments are used only on a white background fabric for achieving a "white-on-white" effect. White pigment printing pastes are not generally applied to darker background colors, since such printing pastes would not provide adequate contrast against the darker background color.

The amount of the opacifying pigment used in the printing paste formulation of this invention is considerably greater than the amount of pigment used in conventional aqueous-based printing pastes, and is typically considerably greater than the total solids content of the polymer binder. In a preferred formulation, the printing paste comprises at least 20 weight percent opacifying pigment (solids basis) and at least 5 weight percent polymer binder (solids basis).

The polymer binder for the opacifying pigment must be capable of application in an aqueous system, form a stable dispersion with the insoluble opacifying pigments and other additives in the binder system, have good film-forming properties when applied to the fabric, and must be capable of being dried and cured to a water insoluble state imparting good washfastness and abrasion resistance properties to the printed pattern. The polymer binder may be suitably applied as an aqueous solution or as an aqueous dispersion or latex. The drying and curing of the print paste may be accomplished by suitable means, such as by heating, and various mechanisms may be employed for curing the binder, i.e., converting the polymer binder from an aqueous solution or dispersion as it is applied to a water insoluble state in the final product. For example, the curing may involve the reacting or splitting off of water solubilizing groups, such as carboxyls, condensation or addition polymerization, radiation curing or crosslinking.

One example of a particularly suitable curable polymer binder system for the opacifying pigment is an aqueous film-forming crosslinkable latex. The latex composition suitable for use in the present invention is a stable dispersion of polymers and/or copolymers in water which will effectively maintain the pigment in uniform suspension, and when printed onto the fabric, will coat the yarns of the fabric with a thin film of the latex and pigment. Upon heating, the latex film dries and cures, with a crosslinking reaction taking place between the reactive side groups of the polymer chains. There is thus formed a tough, flexible, water-insoluble pigmented opaque film around the yarns in the areas of the fabric where the printing paste is applied. If the particular latex polymer used is not itself heat reactive, then suitable catalysts or curing agents are added to promote curing and crosslinking upon heating.

A preferred class of film-forming aqueous latex for use with this invention are acrylic latexes. These are aqueous, anionic, colloidal dispersions of acrylate polymers and copolymers. An example of suitable commercially available acrylic latexes is the Hycar series of acrylic latexes available from B. F. Goodrich Company. Other heat reactive film-forming aqueous latexes suitable for use in the present invention include styrene-butadiene latexes, polyvinyl chloride and polyvinylidene chloride latexes, polyvinyl pyrimidine latexes, and polyacrylonitrile latexes.

To provide enhanced abrasion resistance and washfastness, a heat reactive crosslinking agent capable of crosslinking with the latex may optionally be included in the binder system. The crosslinking agent serves to reinforce the cured latex structure and thereby provide enhanced wet abrasion resistance and washfastness properties to the printed area. The crosslinking agent is a compound or resin (polymer) having functional groups capable of reacting with reactive sites on the latex under curing conditions to thereby produce a crosslinked structure. Examples of reactive chemical compounds suitable as crosslinking agents include aldehydes and dialdehydes such as formaldehyde and glyoxal. Examples of reactive thermoplastic or thermosetting resins suitable as crosslinking agents include glyoxal resins, melamines, triazones, urons, carbamates, acrylamides, and silicone resins. One particularly suitable type of heat reactive crosslinking resin is a melamine-formaldehyde condensation product, one example of which is AEROTEX RESIN MW, produced by American Cyanamid Company.

The polymer binder system may also suitably employ polymers which are not themselves crosslinking and to which additional crosslinking agents are not added. Suitable nonreactive polymeric resins of this type may for example, be based on polyvinyl chloride or polyvinylidene chloride, such as the Geon series of resins available from B. F. Goodrich. Other suitable nonreactive resins include polyester resins, polysiloxane resins, polyvinyl alcohol and polyvinyl acetate. Instead of forming crosslinks, these resins, upon curing, fuse together the individual polymer particles to form individual polymer particles to form entangled polymer chains with good adhesive properties. The polymeric material selected may be applied either as a suspension, an emulsion or in solution.

The dyes which may be suitably employed for coloring the binder may comprise at least one member selected from the group consisting of acid dyes, cationic dyes, direct dyes, disperse dyes, fiber reactive dyes, mordant dyes, and solvent dyes. Azoic dyes, vat dyes, and sulfur dyes may also be used; however, the azoic compounds, vat dyes and unreduced sulfur dyes would in effect behave as pigments since in the unreduced form they are insoluble.

Selected monomers or polymers having cationic or acidic dye sites may also be included in the binder system to enhance the brilliance and fastness properties of the particular dyes selected. Natural gums and polymers or synthetic polymers containing hydroxyl groups, amide linkages or amino groups may also be incorporated to yield improved fastness properties and brilliance of fiber reactive dyes.

Where acid dyes are used, specific monomers or polymers containing dye sites available to form ionic bonds with the acid dyes may suitably be included in the binder system. For example, urethane polymers such as Nopcothane-D610 or an acrylamide copolymer such as American Cyanamid Size TS-10M may be included in the binder system along with an acid dye such as Acidol Yellow 3GLE.

Where cationic dyes are employed, specific monomers or polymers containing dye sites available to form ionic bonds with cationic dyes may be included in the binder system. An example would be the incorporation of a nitrile latex such as B. F. Goodrich Hycar 1572 with a cationic dye such as Astrazon Red FBL.

Disperse dyes may be used to color the opaque print paste, especially where specific polymers are added which would allow the uptake of a disperse dye by diffusion during the curing process. Such a polymer could be, for example, a water dispersible polyester sizing compound such as Eastman Size WD. Foron Red SEVS is a disperse dye that has been found to yield a red opaque print on a black fabric in such a system.

Direct dyes may be added directly to the opaque print mix. They rely on hydrogen bonding and physical entrapment in the polymer matrix. An example of such a dye that has been found to give good coloration to the opaque print mix is Sol-Aqua-Fast Scarlet TFL.

Fiber reactive dyes may be added directly to the print paste and polymers containing hydroxyl or amine groups may be added to promote sites for covalent bonding with the fiber reactive dye. Opaque print pastes have been made which incorporate natural gums such as Kelgin XL or synthetic polymers such as polyvinyl alcohol which will provide hydroxyl groups. A fiber reactive dye which has been found to yield good results is Remzaol Green GB.

The amount of dye to be included in the print paste depends upon the shade desired. Combinations of dyes and dyes from different classes and combinations of dyes and colored pigments can also be employed to achieve various desired shades. Where additional polymers are added to the print paste, they may be typically added at a level of about 10 to 20 percent based on the total weight of the mix.

An example of an aqueous opaque mix to which dyes may be added as colorants is as follows:

| | |
|---|---|
| Pioneer White BS | 57.5 |
| Propylene Glycol | 3.1 |
| Varsol | 3.1 |
| Hycar 2679 or Hycar 1572 | 15.4 |
| Blockout B | 13.1 |
| Resin MW | 4.6 |
| Ammonia | .8 |
| Quickset P | .9 |

-continued

| | |
|---|---|
| Thickener Concentrate T | 1.5 |

Silicone fluids and elastomers may be incorporated into the printing paste to aid in obtaining a smooth application of the pigment to the fabric. The use of silicone polymers has been found to provide dots or designs free of rough edges and crack marks. Silicone resin polymers may also be employed as a substitute for or in addition to the thermoplastic or thermosetting resins.

Conventional thickeners may also be utilized to control the viscosity and rheology of the paste, depending upon the size and design of the print pattern and the running speed of the print screen.

The paste may also contain other conventional additives, such as emulsifiers, antifoam agents, and pH control agents. It is important that the printing paste have good wetting and film-forming properties so that when applied to the fabric, it will penetrate and coat the individual yarns of the fabric rather than remaining on the surface of the fabric. If these properties are not adequately presented by the polymer binder itself, suitable wetting agents or emulsifiers may be included.

The printing paste may be applied either to uncolored (e.g. white) fabrics or to precolored fabrics, the precolored fabrics being of a predetermined color throughout and produced by any suitable method such as by piece dyeing, yarn dyeing or by pigment padding, for example.

The particular rate of application of the printing paste to the fabric will vary depending upon various factors, including fabric weight and construction, color of the fabric, and printing color.

Drying and curing of the printing paste may be carried out under conditions of temperature and time conventional for the particular manner of application. For rotary screen printing, for example, drying and curing may be carried out at temperatures of 250 to 400 degrees F. for from several seconds up to several minutes. Energy savings and improved fabric properties may be realized by curing at lower temperatures, with the selection of a suitable low temperature curing polymer binder. For curing at low temperature, it may be desirable to include a crosslinking catalyst. The particular catalyst chosen would depend upon its compatibility with the crosslinking resin, the polymer binder, and the other components in the paste. Many latex and resin emulsions are known to precipitate in solution in the presence of acid catalysts and catalysts containing polyvalent ions such as are found in metallic and organometallic catalysts such as magnesium chloride. One class of catalyst which has been particularly useful for low temperature curing is an ammonium capped sulfonic acid catalyst such as Quickset P. This catalyst is mildly acidic and does not disrupt the mildly alkaline pH for the latex mix in the quantities used. On curing, the ammonia is released, leaving the sulfonic acid group, which causes the pH to become acidic and providing an acid catalyst for the system. The catalyst would then behave as a conventional methane sulfonic acid or p-toluene sulfonic acid catalyst.

When the fabric is cured and dried, the areas printed with the printing paste are characterized by having a thin flexible opaque coating covering the exposed surfaces of the yarn and thus hiding from view the underlying color of the yarn. The coating consists predominantly of the opacifying pigment bonded securely to the yarns by the cured water insoluble polymer binder.

The photomicrograph of FIG. 1 clearly illustrates the structure of the opaque colored coating produced by the printing paste of the invention. The opaque coating is characterized by penetrating each yarn and individually encapsulating and coating the exposed fibers at the surface of the yarn. However, the fabric structure defined by the interwoven yarns is not obliterated by the coating and remains clearly visible. Further, the individual surface fibers of the yarns also remain visible, indicating that the coating has penetrated into the yarn rather than remaining on the surface of the fabric or on the outer surface of the individual yarns. The completeness and the opacity of the coating is also evident from the contrast in appearance between the printed areas and the adjacent nonprinted areas; a flat or dull appearance being exhibited by the opaque coating in printed areas in contrast to the luster of the uncoated fibers in the nonprinted areas.

Figure 2:
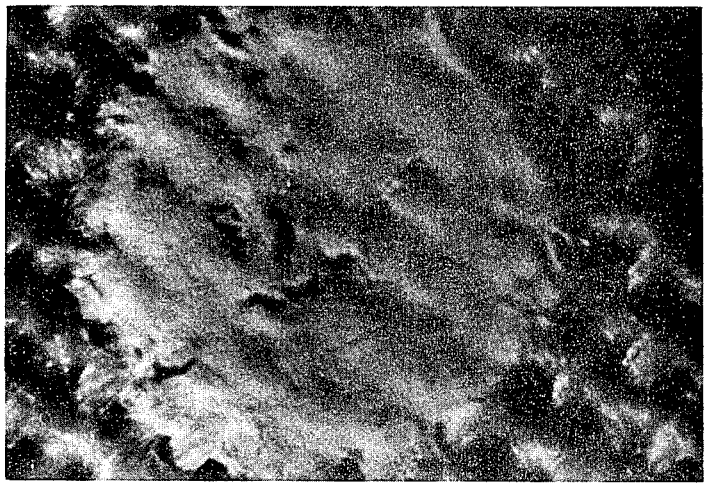
FIGS. 2 and 3, for purposes of comparison, are photomicrographs showing a similar fabric with an opaque printed area thereon produced, respectively, by a commercially practiced aqueous printing technique, and by solvent-based lacquer printing techniques known in the art.

FIG. 2 shows a printed area produced by a commercially practiced printing technique in which an aqueous printing paste is applied to the fabric in a very thick layer in an effort to achieve the desired opacity. As is evident from the photomicrograph, the printing paste has dried and cured to form a "skin" which has remained on the surface of the fabric rather than penetrating into the fabric. The woven structure of the fabric is obliterated and hidden from view by the thick skin-like deposit. The photomicrograph reveals evidence of crusting over during drying and curing, giving a "mud-cracked" appearance. These printed areas exhibit poor abrasion resistance and washfastness properties.

Figure 3:
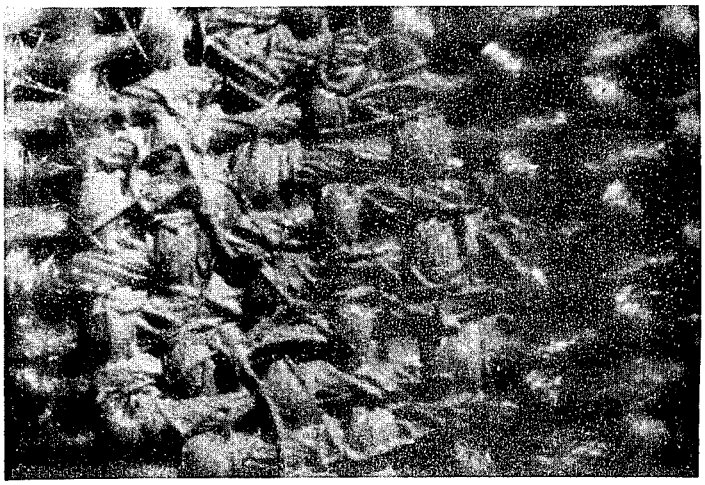

FIG. 3 shows a printed area produced from a solvent-based lacquer printing formulation. The printed areas exhibit a glossy appearance indicative of the lacquer composition. While the formulation has penetrated the fabric to some extent, such that woven fabric structure is not completely obliterated, a significant proportion of the composition remains on the surface of the fabric and in the outermost portions of the individual yarns, such that in many areas the individual fibers at the outer surface of the yarns are hidden from view by the coating.

Because of the excellent opacity of the aqueous opaque colored printing paste formulations of the present invention, which permits printing vivid contrasting colors on predyed fabrics of any desired color, and the fact that the printing paste formulations of this invention can be readily applied on conventional rotary screen printing equipment, the present invention makes it possible to produce a variety of colors and patterns not heretofore possible. Thus, one additional aspect of the present invention is the production of a printed textile fabric formed of precolored yarns, and in particular dyed yarns of a predetermined color, selected areas of the fabric having printed pattern areas of predetermined color contrasting with the color of the yarns, the printed pattern areas being substantially opaque and thus unaffected by the color of the yarns, and the pattern areas being formed of a plurality of colors contrasting with one another and with said predetermined color of the yarns, at least one of the colors being lighter than said predetermined color dyed yarns, and said pattern areas comprising a filmlike coating covering the exposed surfaces of the yarns, said coating comprising an opacifying pigment providing opacity in said coating and a thermosetting crosslinked latex polymer binder securely bonding said opacifying pigment to the yarns.

In the drawings and specification, there has been set forth a preferred embodiment of the invention, and although specific terms are employed, they are used in a generic and descriptive sense only and not for purposes of limitation.

That which is claimed is:

1. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the interengaged yarns and hiding the underlying color of the yarns, said coating comprising an opacifying pigment providing opacity in said coating and a cured water insoluble polymer binder affixed to said yarns and bonding said opacifying pigment to the yarns, and a dye coloring said polymer binder and thereby imparting said predetermined color to the printed area.

2. A printed textile fabric as set forth in claim 1 wherein said coating additionally includes colored pigments for assisting said dyes in providing said predetermined color to the printed pattern areas.

3. A printed textile fabric as set forth in claim 1 wherein said polymer binder contains reactive dye sites available for bonding with said dye, and said dye is chemically reacted with said dye sites.

4. A printed textile fabric as set forth in claim 1 wherein said dye comprises at least one member selected from the group consisting of acid dyes, cationic dyes, direct dyes, disperse dyes, fiber reactive dyes, mordant dyes and solvent dyes.

5. A printed textile fabric as set forth in claim 1 wherein said printed pattern areas are formed of a plurality of colors contrasting with one another and with said predetermined color of the yarns, at least one of the colors of the printed pattern areas being lighter than said predetermined color of said yarns.

6. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the interengaged yarns and bonded thereto and hiding the underlying color of the yarns, said opaque coating comprising an opacifying pigment, a crosslinked acrylic latex polymer, a heat reactive acrylic resin crosslinked with said acrylic latex polymer, a curing catalyst, and a dye coloring said latex polymer and thereby imparting said predetermined color to the printed area.

7. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque pigmented coating bonded to the interengaged yarns and hiding the underlying color thereof, said pigmented coating penetrating each yarn and individually encapsulating and coating the exposed fibers at the surface of the yarn while allowing the interengaged yarn structure of the fabric as well as the individual surface fibers of the yarn to remain visible in the printed pattern areas, said opaque coating comprising an opacifying pigment providing opacity in said coating, a cured water insoluble binder, and a dye coloring said polymer binder and thereby imparting said predetermined color to the printed area.

8. In the printing of textile fabrics wherein a printing paste containing pigments and a heat curable binder is applied to selected areas of the fabric and the printing paste is thereafter dried and cured, an improved method of obtaining substantially opaque printed areas of a predetermined color unaffected by the color of the underlying yarns, said method comprising applying to the fabric a printing paste comprising a stable dispersion of an opacifying pigment, an aqueous, curable polymer binder, and a dye for imparting said predetermined color to said polymer binder, said printing paste being applied to the fabric in an amount sufficient to form in the dried and cured fabric an opaque coating covering the exposed surfaces of the yarns and hiding the underlying color thereof.

9. The method as set forth in claim 8 wherein said aqueous printing paste additionally includes colored pigments.

10. The method as set forth in claim 8 wherein said step of applying the aqueous printing paste to the fabric comprises printing the paste onto the fabric at the printing station of rotary stencil printing apparatus.

11. The method as set forth in claim 8 wherein said step of applying the aqueous printing paste to the fabric is carried out with a plurality of colors at successive stations of a rotary screen printing apparatus.

12. The method as set forth in claim 8 wherein said step of applying the aqueous printing paste to the fabric comprises applying the printing paste to a precolored fabric.

* * * * *

UNITED STATES PATENT AND TRADEMARK OFFICE

Certificate

Patent No. 4,438,169 Patented March 20, 1984

John Y. Daniels and James C. Stevenson

Application having been made by John Y. Daniels and James C. Stevenson, the inventors named in the patent above identified, and Springs Industries, Inc., the assignee, for the issuance of a certificate under the provisions of Title 35, Section 256, of the United States Code, deleting the name of James C. Stevenson as a joint inventor, and a showing and proof of facts satisfying the requirements of the said section having been submitted, it is this 26th day of Mar., 1985, certified that the name of the said James C. Stevenson is hereby deleted from the said patent as joint inventor with the said John Y. Daniels.

Fred W. Sherling,
*Associate Solicitor.*